US005746652A

United States Patent [19]

Lee et al.

[11] Patent Number: 5,746,652

[45] Date of Patent: May 5, 1998

[54] ACTIVATED AIR SHOWERING SYSTEM FOR CLEAN ROOM AND METHOD FOR CONTROLLING THE SAME

[75] Inventors: Joung-Sun Lee, Suwon; Dae-Yul Kim; Yo-Han An, both of Seoul; Jae-Kang Jun, Anyang, all of Rep. of Korea

[73] Assignee: Samsung Electronics Co., Ltd., Suwon, Rep. of Korea

[21] Appl. No.: 771,775

[22] Filed: Dec. 20, 1996

[30] Foreign Application Priority Data

Dec. 29, 1995 [KR] Rep. of Korea ..... 95-65738

[51] Int. Cl.[6] ..... B01L 1/04

[52] U.S. Cl. ..... 454/187

[58] Field of Search ..... 454/187, 56, 57

[56] References Cited

U.S. PATENT DOCUMENTS 4,676,144 6/1987 Smith, III ..... 98/1.5

5,042,367 8/1991 Hopkins ..... 98/87

FOREIGN PATENT DOCUMENTS 292-314-A 7/1991 Germany ..... 454/187

0225838 10/1987 Japan ..... 454/187

0115641 4/1990 Japan ..... 454/187

*Primary Examiner*—Harold Joyce

*Assistant Examiner*—Derek S. Boles

*Attorney, Agent, or Firm*—Jones & Volentine, L.L.P.

[57] ABSTRACT

An activated air showering system for a clean room includes a plurality of shower disks provided on a floor of the clean room, where each of the disks is formed with a plurality of exhaust holes for exhausting particles released from a worker. A sensing device senses the presence of the worker on the shower disk and a driving device drives the shower disk in response to a signal from the sensing device. Air sprayers emit air when the shower disk is driven by the driving device to remove foreign particles from the worker.

14 Claims, 4 Drawing Sheets

ACTIVATED AIR SHOWERING SYSTEM FOR CLEAN ROOM AND METHOD FOR CONTROLLING THE SAME

BACKGROUND OF THE INVENTION

1. Field of the Invention

The present invention relates to an activated air showering system for a clean room and a method for controlling the same, and more particularly, to an activated air showering system for a clean room and a method for controlling the same, in which the structure of a floor of a clean room is changed such that showering efficiency can be maximized.

2. Description of the Related Art

Referring to FIG. 1, there is illustrated a front view of an air cleaning room of the prior art. The clean room 10, which is generally provided at an entrance of a working room, includes an entrance door 1 through which a worker enters into the working room, and a plurality of air spraying holes 2 formed on vertical walls and a ceiling thereof. A plurality of exhausting holes 4 are formed in a floor 3 of the clean room 10 to exhaust particles that are released from the body of the worker while spraying air through the plurality of air spraying holes 2.

After the worker enters the clean room 10 through the entrance door 1, the entrance door 1 automatically closes. Then, air is sprayed onto the worker through the plurality of air spraying holes 2, and the particles on the worker are released from the worker and exhausted through the plurality of exhausting holes 4. After this, the worker can exit the clean room 10 through an exit door (not shown).

However, the clean room 10 of the prior art suffers from a drawback in that since most of the workers stand stationary in the clean room 10, there arises a possibility that the particles will not be completely removed. In other words, although it is necessary for the worker to move actively in the clean room 10 while showering to improve showering efficiency, it is found that about 80% of the workers do not follow this rule.

SUMMARY OF THE INVENTION

Accordingly, the present invention has been made in an effort to solve one or more of the problems occurring in the conventional art, and it is an object of the present invention to provide an activated air showering system for a clean room and a method for controlling the same, in which the structure of a floor of a clean room is changed such that showering efficiency can be maximized.

According to one aspect of the present invention, there is provided an activated air showering system for a clean room, comprising: a plurality of shower disks provided on a floor of the clean room, each of the shower disks being formed with a plurality of exhaust holes for exhausting particles released from a worker; sensing means for sensing the presence of the worker on the shower disk; driving means for driving the shower disk in response to a signal from the sensing means; and air spraying means for spraying air when the shower disk is driven by the driving means.

According to another aspect of the present invention, the sensing means includes a photo sensor for emitting light and a reflecting mirror for reflecting the light emitted from the photo sensor.

According to another aspect of the present invention, the driving means includes a rotating shaft having a driving wheel which contacts with a radial outer lower surface of the shower disk to transmit power to the shower disk. The driving wheel is preferably made of polyurethane. In addition, the driving wheel is rotated at a relatively low speed to sufficiently remove the particles from the worker.

According to another aspect of the present invention, the driving means further includes a plurality of ball bearings which contact a center of the lower surface of the shower disk.

According to another aspect of the present invention, the air spraying means is automatically stopped after the shower disk is rotated for a predetermined time.

According to another aspect of the present invention, the shower disk is rotatably supported by a plurality of guide rollers. The guide rollers are preferably made of polyurethane.

According to yet still another aspect of the present invention, there is provided a method for controlling an activated air showering system for a clean room, comprising the steps of: inputting rotating speed and initial operating mode information of a motor into a control section; simultaneously operating the motor and an air spraying means in response to the information input into the control section; detecting an updated operating condition of the motor and inputting it into the control section; and simultaneously stopping the motor and the air spraying means in response to the updated operating condition in the detecting step.

By the features of the present invention, the structure of a floor of a clean room is changed to maximize showering efficiency.

BRIEF DESCRIPTION OF THE DRAWINGS

The above objects, other features and advantages of the present invention will become more apparent after a reading of the following detailed description taken in conjunction with the drawings, in which.

DETAILED DESCRIPTION OF PREFERRED EMBODIMENTS

Hereinafter, an activated air showering system for a clean room in accordance with an embodiment of the present invention will be described in greater detail with reference to FIGS. 2 through 6.

Figure 2:
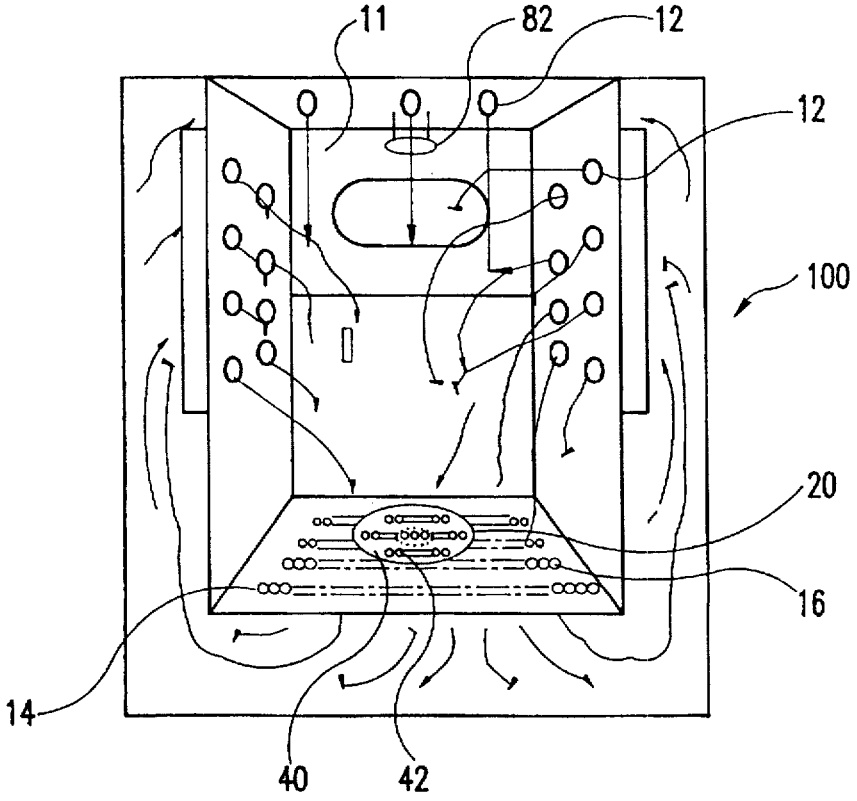
FIG. 2 is a front view of an activated air showering system of a clean room in accordance with an embodiment of the present invention.
Figure 3:
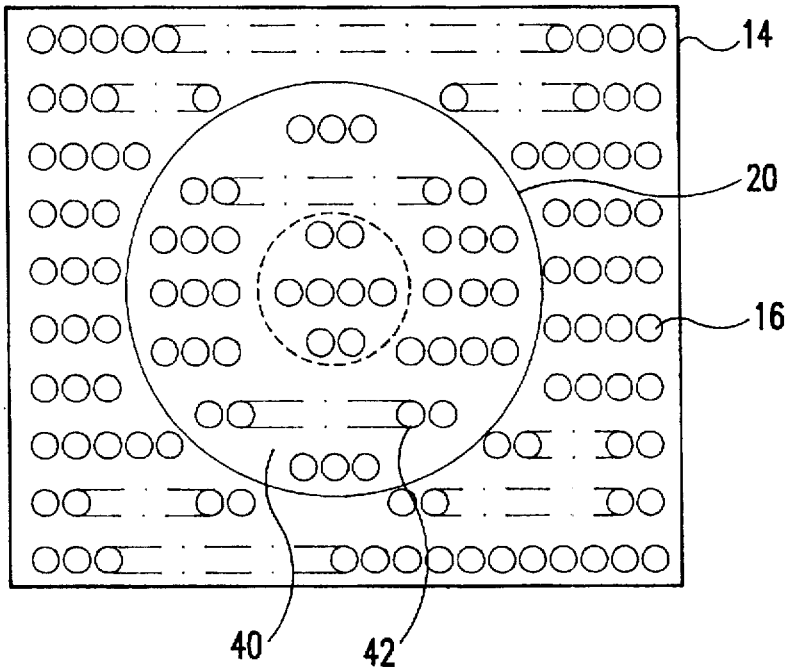
FIG. 3 is a plan view of a floor of the clean room of FIG. 2.

Referring now to FIGS. 2 and 3, the inventive activated air showering system of the present invention includes a clean room 100. The clean room 100 is provided with an entrance door 11 through which a worker enters into a working room, a plurality of spraying holes 12 which are formed in vertical walls and a ceiling of the clean room 100 and through which air is sprayed toward the worker, and a first plurality of exhausting holes 16 which are formed in a floor 14 of the clean room 100 and through which particles released from the worker are exhausted.

The center portion of the floor 14 of the clean room 100 is formed with an opening 20 in which a shower disk 40 having a diameter smaller than that of the opening 20 is provided. The reason why the diameter of the shower disk 40 is smaller than that of the opening 20 is to prevent friction from occurring between the shower disk 40 and the inner wall of the floor 14 defining the opening 20, thereby reducing the wear of the shower disk 40. The shower disk 40 is preferably made from stainless steel and is also formed with a second plurality of exhausting holes 42 to have an opening ratio, namely, the ratio of the area of the openings compared to the total shower disk area, that is equal to or greater than 50%.

Figure 4:
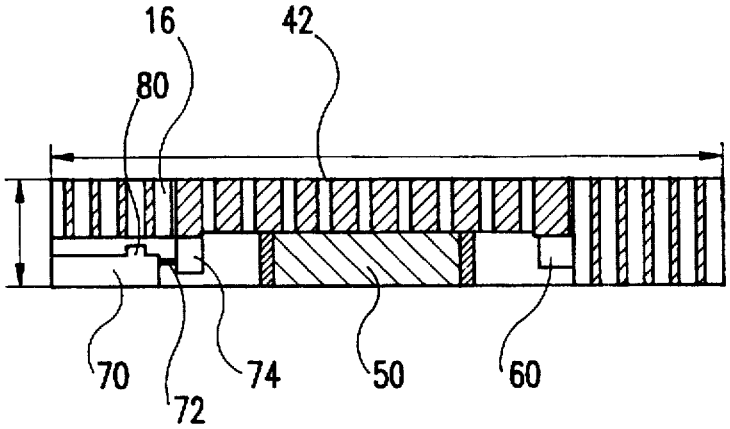
FIG. 4 is a cross-sectional view of the floor of FIG. 3.

Referring to FIG. 4, a ball bearing 50 is disposed under the shower disk 40 to guide the rotation of the shower disk 40. The ball bearing 50 includes a plurality of balls 54 which are held in a retainer 52 arranged between an outer race and an inner race as shown in FIG. 5.

A plurality of guiding parts 60 are integrally fastened to the inner wall of the floor 14 which defines the opening 20, to contact with the radial outer portion of the lower surface of the shower disk 40, thereby to support and disperse the load applied to the shower disk 40 while it is rotated. Preferably, the guiding parts 60 are made from polyurethane having high wear-resistance characteristics.

Figure 1:
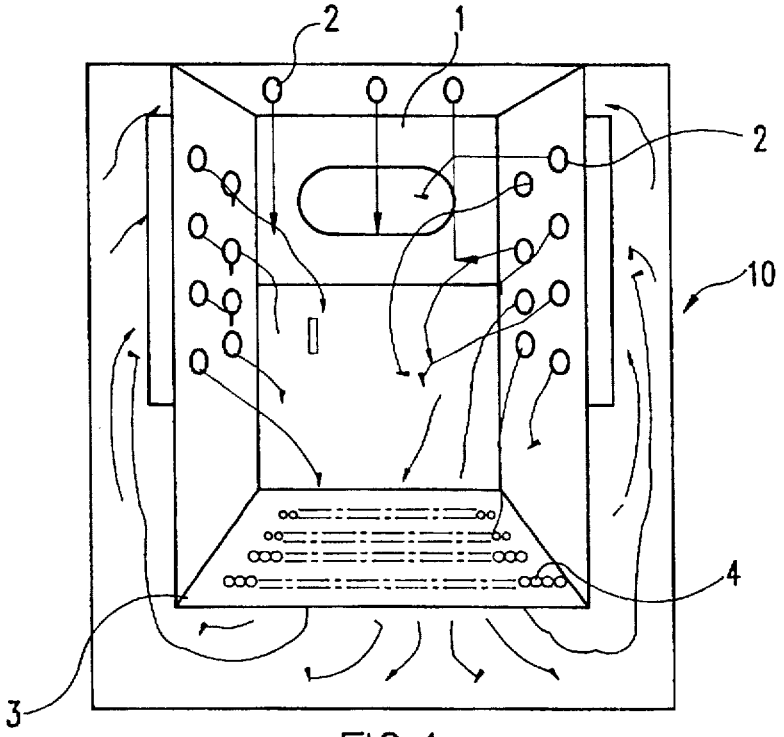
FIG. 1 PRIOR ART
FIG. 1 is a front view of a conventional clean room.
Figure 5:
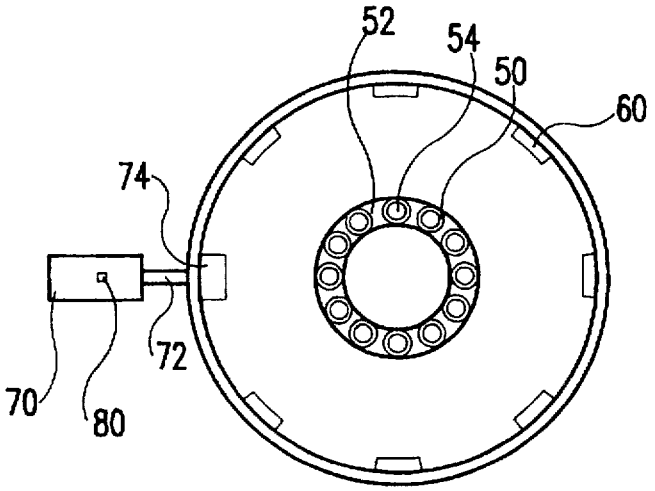
FIG. 5 is a schematic plan view of a driving part of the activated air showering system of the present invention.

As seen in FIGS. 4 and 5, below the floor 14 adjacent the opening 20, there is provided a motor 70. A cylindrical driving wheel 74 is secured to the distal end of a rotating shaft 72 of the motor 70 to contact with the lower surface of the shower disk 40, thereby to transmit the rotating force of the motor 70 to the shower disk 40. The cylindrical driving wheel 74 is made from urethane and is rotated at a low speed of about 3 rpm to sufficiently remove particles adhered to the worker. A photo sensor 80 is attached to the motor 70 to emit and receive a light, and a reflective mirror 82 (see FIG. 1) is mounted to the ceiling of the clean room 100 to reflect the light emitted from the photo sensor 80.

Figure 6:
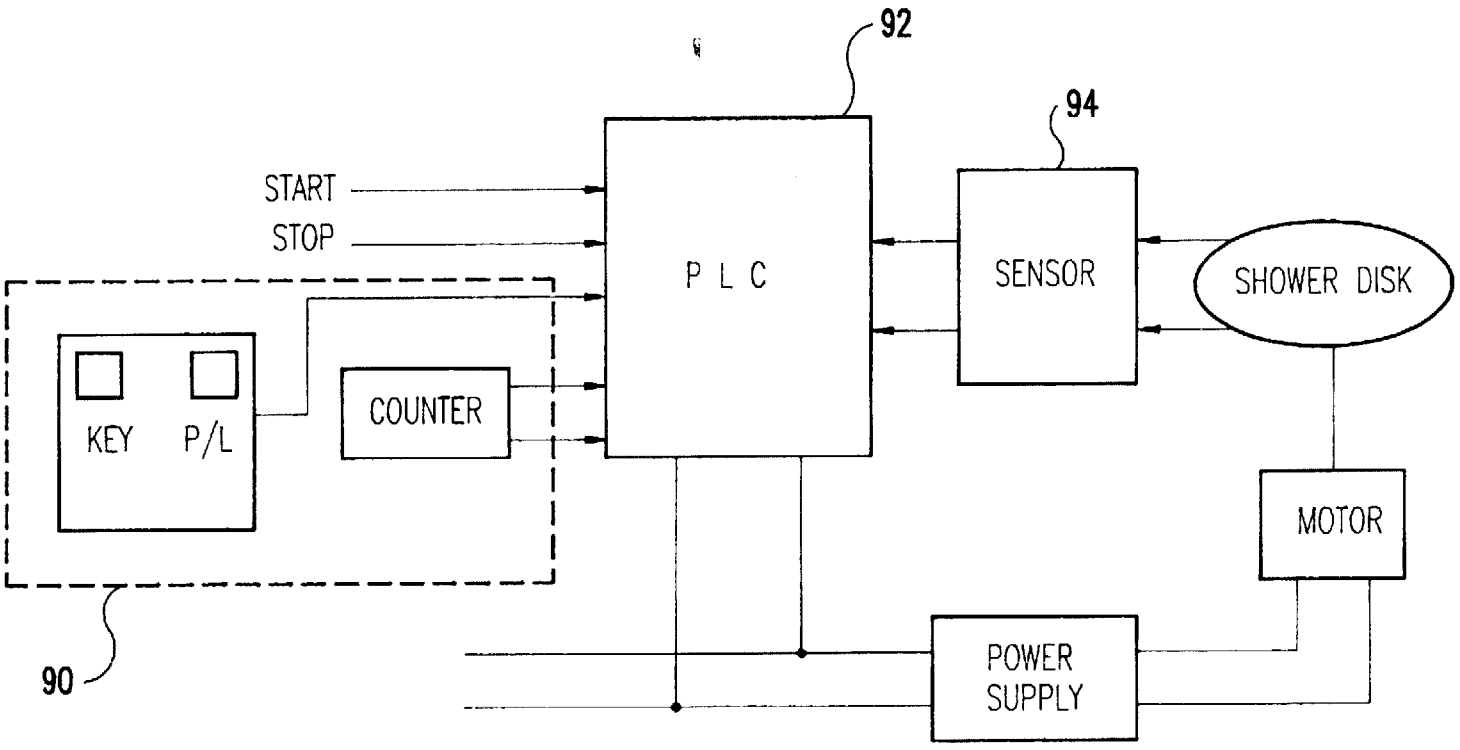
FIG. 6 is a block diagram illustrating a control circuit for the activated air showering system of the present invention.

As shown in FIG. 6, to control the clean room 100 constructed as described above, there are provided an input section 90 for inputting rotating speed and operating mode (manual/automatic) of the motor 70, a control section 92 for controlling the operation of the 20 motor 70 according to the information input into the input section 90, and a detecting section 94 for detecting the operating condition of the motor 70 and inputting it into the control section 92.

The operation of the activated air showering system for clean room according to the present invention will be fully described hereinafter.

In the automatic mode, the worker enters into the clean room 100 through the entrance door 11, and stands on the shower disk 40 provided on the center of the floor 14 of the clean room 100. At this time, light emitted from the photo sensor 80 is reflected by the reflecting mirror 82 and is then absorbed by the worker. Accordingly, since the light is not absorbed into the photo sensor 80, the control section 92 operates the motor 70. At the same time, air is sprayed through the plurality of spraying holes 12, and the driving wheel 74 attached to the rotating shaft 72 of the motor 70 is rotated. This causes the shower disk 40, which is contacting the driving wheel 74, to start to rotate while being supported by the ball bearing 50 and the guiding parts 60. Therefore, the worker can be showered while being rotated. During this operation, the rotating condition of the motor 70 is detected by the detecting section 94. After a predetermined amount of time or a designated amount of shower disk revolutions is detected by the detecting section 94, the control section 92 stops the rotation of the shower disk 40 and air spraying operation through the plurality of spraying holes 12. After this, the worker exits the clean room 100 through an exit door.

In the manual mode, an operator can control the above-described operations in a control room.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. An activated air showering system for a clean room comprising:

a plurality of shower disks provided on a floor of said clean room, each of said shower disks being formed with a plurality of exhaust holes for exhausting particles released from a worker;

sensing means for sensing the presence of the worker on said shower disk;

driving means for driving said shower disk in response to a signal from said sensing means; and air spraying means for spraying air when said shower disk is driven by said driving means.

2. An activated air showering system for a clean room as claimed in claim 1, wherein said plurality of exhaust holes in said shower disks have an opening ratio greater than or equal to 50%.

3. An activated air showering system for a clean room as claimed in claim 1, wherein said sensing means includes a photo sensor for emitting light and a reflecting mirror for reflecting said light emitted from said photo sensor.

4. An activated air showering system for a clean room as claimed in claim 1, wherein said driving means includes a rotating shaft having a driving wheel which contacts with a radial outer lower surface of said shower disk to transmit power to said shower disk.

5. An activated air showering system for a clean room as claimed in claim 1, wherein said air spraying means is automatically stopped after said shower disk is rotated for a predetermined time.

6. An activated air showering system for a clean room as claimed in claim 1, wherein said shower disk is rotatably supported by a plurality of guide rollers.

7. An activated air showering system for a clean room as claimed in claim 4, wherein said driving wheel is made of polyurethane.

8. An activated air showering system for a clean room as claimed in claim 4, wherein said driving wheel is rotated at a low speed to sufficiently remove said particles from the worker.

9. An activated air showering system for a clean room as claimed in claim 8, wherein said driving wheel is rotated at about three revolutions per minute.

10. An activated air showering system for a clean room as claimed in claim 4, wherein said driving means further includes a plurality of ball bearings which contact a center of said lower surface of said shower disk.

11. An activated air showering system for a clean room as claimed in claim 6, wherein said guide rollers are made of polyurethane.

12. A method for controlling an activated air showering system for a clean room, comprising the steps of:

inputting rotating speed and initial operating mode information of a motor into a control section;

simultaneously operating said motor and an air spraying means in response to the information input into said control section;

detecting an updated operating condition of said motor and inputting it into said control section; and simultaneously stopping said motor and said air spraying means in response to the updated operating condition in said detecting step.

13. The method for controlling an activated air showering system for a clean room as claimed in claim 12, wherein the initial operating mode information in said inputting step is one of automatic operation and manual operation.

14. A method for controlling an activated air showering system for a clean room as claimed in claim 12, wherein said updated operating condition in said detecting step is one of a predetermined amount of time and a designated number of revolutions of the shower disk.

* * * * *